US005467824A

United States Patent [19]

DeMarsh et al.

[11] Patent Number: 5,467,824

[45] Date of Patent: Nov. 21, 1995

[54] APPARATUS FOR AND A METHOD OF SEVERING MULTIPLE CASING STRINGS USING EXPLOSIVES

[75] Inventors: Peter L. DeMarsh, Picayune, Miss.; William W. Crawford, Slidell, La.

[73] Assignee: Senior Engineering Company, Commerce, Calif.

[21] Appl. No.: 352,910

[22] Filed: Dec. 9, 1994

[51] Int. Cl.[6] ..... E21B 29/02

[52] U.S. Cl. ..... 166/297; 166/55; 166/63; 166/299

[58] Field of Search ..... 166/297, 298, 166/299, 63, 55, 55.1, 162; 102/3.3, 3.2; 299/13

[56] References Cited

U.S. PATENT DOCUMENTS

| | | | |
|---|---|---|---|
| 2,067,408 | 1/1937 | Morris | 166/63 X |
| 2,080,875 | 5/1937 | Pitzer | 166/299 |
| 3,273,642 | 9/1966 | Karpovich | 166/299 |
| 3,654,866 | 4/1972 | Fritz | 102/312 |
| 3,990,512 | 11/1976 | Kuris | 166/299 |
| 4,354,433 | 10/1982 | Owen | 102/307 |
| 4,357,873 | 11/1982 | Jager | 102/310 |
| 4,669,540 | 6/1987 | Luoma et al. | 166/135 |
| 4,694,754 | 9/1987 | Dines et al. | 102/310 |
| 4,787,315 | 11/1988 | Kenny | 102/313 |
| 4,798,244 | 1/1989 | Trost | 166/299 |

*Primary Examiner*—Stephen J. Novosad

*Attorney, Agent, or Firm*—Vaden, Eickenroht, Thompson & Feather

[57] ABSTRACT

A method of and apparatus for severing multiple concentric casing strings in an abandoned oil or gas well allowing the upper portion of the casing strings to be removed comprising positioning a container holding a sealed cylinder full of air at atmospheric pressure that is surrounded by a high velocity explosive in the casing at the location of the desired cut. Igniting the explosive at one end of the container so that the mixture detonates producing a shock wave and gas bubbles that travel downwardly progressively, collapsing the sealed cylinder and increasing the pressure of the air in the cylinder until the cylinder fails whereby pressurized air forced from the cylinder causes the shock wave and gas bubbles from the TNT, RDX, and aluminum mixture to move laterally and sever the casing strings.

5 Claims, 2 Drawing Sheets

FIG. 1
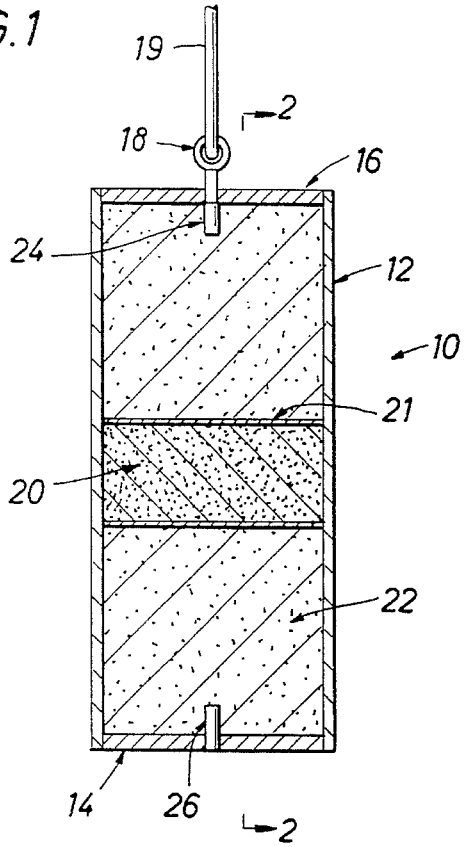
FIG. 2
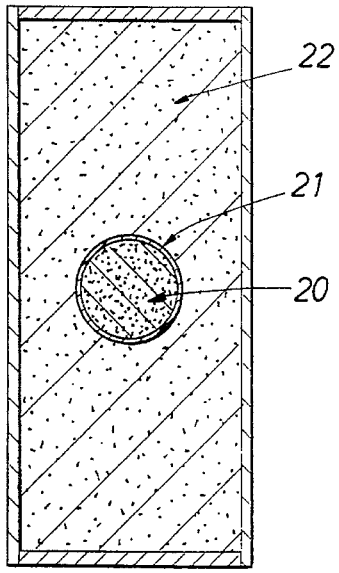
FIG. 3
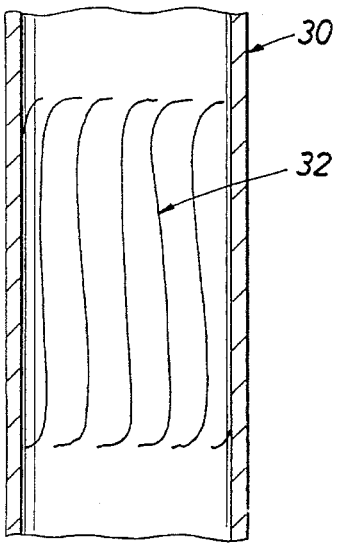
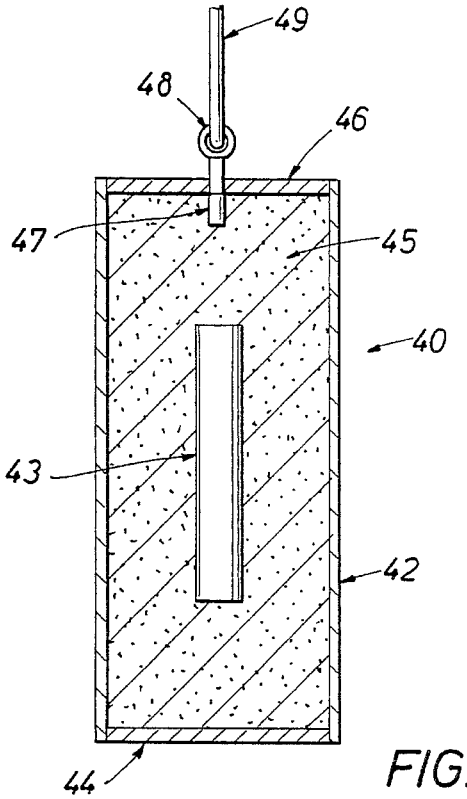
FIG. 4

APPARATUS FOR AND A METHOD OF SEVERING MULTIPLE CASING STRINGS USING EXPLOSIVES

BACKGROUND OF THE INVENTION

1. Field of the Invention

The present invention relates to an apparatus for and a method of explosively severing multiple concentric casing strings using explosives.

2. Description of the Prior Art

Once oil or gas wells in inland lakes, bays, tidelands, and offshore waters are abandoned, the owners are required to remove the upper portion of the casing strings to a point below the mudline so they do not present navigational hazards.

The use of explosive charges to cut pipes is known. Early devices and methods utilized for purposes of removing the upper portion of casing strings and also tubular pilings below the mudline relied upon bulk explosives that, after detonation, produced powerful, unfocused explosive charges. Such explosive charges created shock waves that disrupted marine life and the ecosystem surrounding the abandoned well. Further, the charges often "ripped" the casing, but did not completely sever the upper portion, leaving the casing string frayed but not cut, making it difficult to break away the upper portions of the casing.

Other devices and methods for severing pilings and casings strings include loading canister-shaped carriers with explosives positioned at various circumferential locations on the canister. Such devices and methods frequently do not produce an even and complete cut through the piling or casing, and difficulties in focusing the explosive charge are still encountered. If the force of the explosive charge fails to completely sever the piling or casing, a second carrier and charge must be used to complete the severing process. Another apparatus for severing tubular members is disclosed in U.S. Pat. No. 4,787,315, Kenney, Nov. 29, 1988. The apparatus employs deflection plates, which focus the explosive charge. A large amount of explosive must be used, however, particularly if multiple concentric casing strings are to be cut.

Therefore, it is an object of the present invention to provide an apparatus containing an explosive charge wherein detonation produces a focused shock wave that can sever a series of concentric well casing strings using a reduced amount of explosive, and thereby, producing minimal affect on surrounding marine life.

It is a further object of this invention to provide an apparatus for severing multiple strings of casing comprising a container filled with a quantity of a high velocity explosive surrounding a sealed cylinder in the center of the container, a detonator at one end of the container for detonating the high velocity explosive to cause a shock wave and gas bubbles to move toward the center and collapse the cylinder causing it to fail, whereby pressurized air from the cylinder causes the shock wave to move laterally through the casing strings.

It is a further object of this invention to provide a method of simultaneously severing multiple concentric casing strings in an abandoned, oil or gas well located in a body of water comprising lowering an elongated container holding a sealed cylinder in the center of the container and a high velocity explosive surrounding the cylinder, detonating the high velocity explosive so that the high velocity explosive detonates toward the sealed cylinder thereby producing a shock wave and gas bubbles that travel toward the sealed cylinder, the detonating high velocity explosive causing the sealed cylinder to collapse and fail, whereby pressurized air from the cylinder causes the shock wave and gas bubbles from the high velocity explosive to move laterally to sever the upper portions of the concentric casing strings from the lower portions thereof.

It is another object of the present invention to provide a method of simultaneously severing multiple casing strings in an abandoned oil or gas well located in a body of water to allow the upper portion of the casing strings to be removed so as not to be a hazard to navigation, comprising lowering an elongated container holding a mixture of TNT, RDX, and aluminum surrounding a sealed cylinder, detonating the TNT, RDX and aluminum mixture at one end away from the center of the container causing the TNT, RDX, and aluminum mixture to burn toward the sealed cylinder, producing a shock wave and gas bubbles that travel toward the cylinder such that the detonating mixture reaches the cylinder and collapses the cylinder causing it to fail, whereby pressurized air from the cylinder causes the shock wave and gas bubbles from the TNT, RDX, and aluminum mixture to form a concentrated shock wave that moves laterally to sever the casing.

These and other objects, advantages, and features of this invention will be apparent to those skilled in the art from reading this specification including the attached drawings and appended claims.

BRIEF DESCRIPTION OF THE DRAWINGS

FIG. 1 is a sectional view of an apparatus that failed to sever multiple concentric casing strings.

FIG. 2 is a cross-sectional view of the apparatus of FIG. 1 shown along the line 2—2.

FIG. 3 is a sectional view of a casing following detonation of the apparatus of FIG. 1.

FIG. 4 is a sectional view of the preferred embodiment of the present invention.

DESCRIPTION OF THE PREFERRED EMBODIMENT

Figure 5:
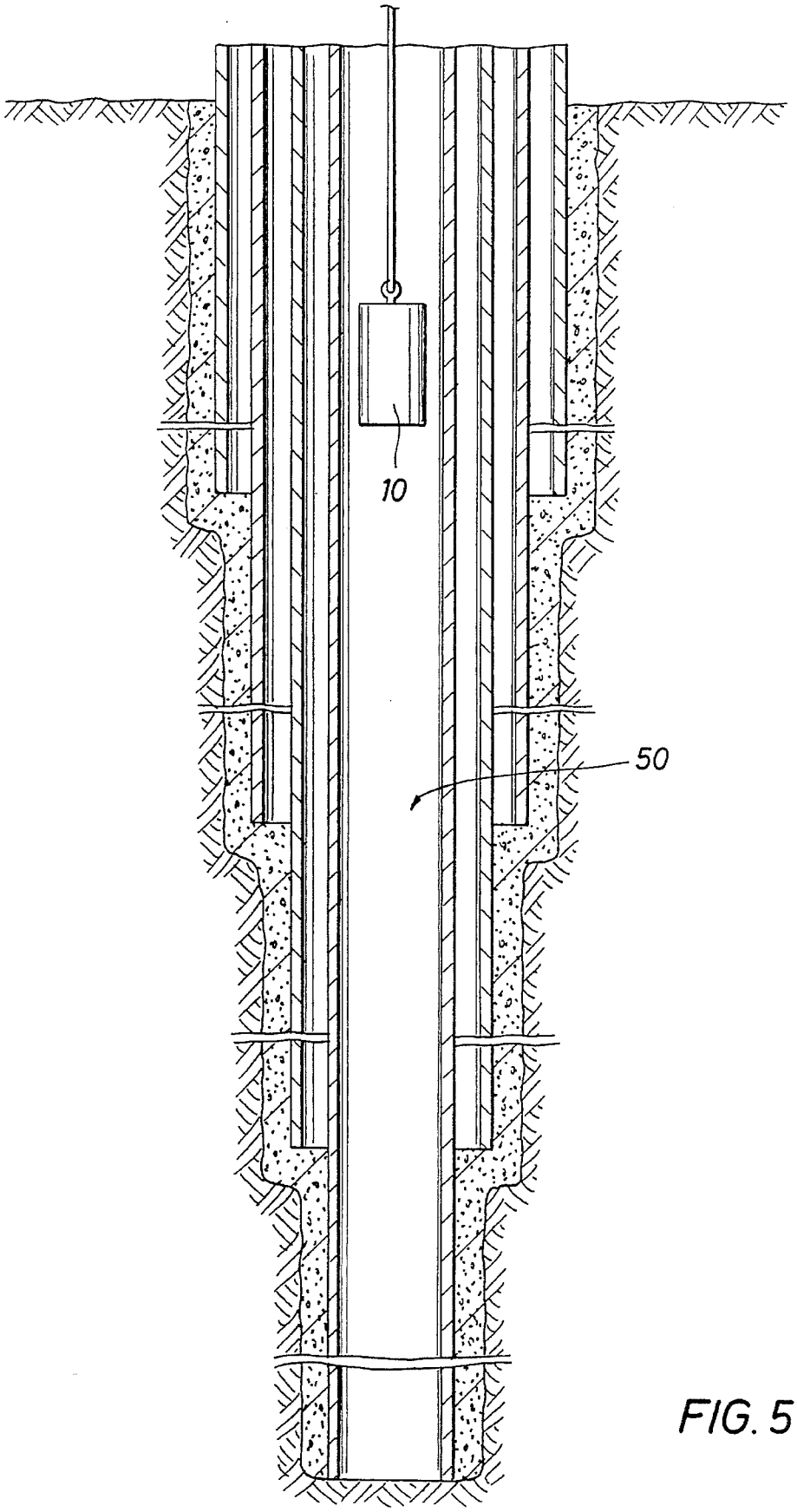
FIG. 5 is a sectional view of the apparatus of this invention positioned to sever multiple concentric casing strings.

Apparatus 10, shown in FIG. 1, was the first attempt to sever multiple casing string with explosives. It includes elongated cylindrical container 12 that is closed at the bottom by end plate 14 and at the top by end plate 16. Electric cable 19 was connected to eye bolt 18 in the top plate for supporting the container as it was lowered into the casing.

Cylinder 21 filled with low velocity explosive 20 was positioned in the center of container 12 with the longitudinal axis of the container perpendicular to longitudinal axis of container 12. Ammonium nitrate was the selected low velocity explosive. Container 12 was filled with high velocity aluminized explosive mixture 22. Aluminized explosive mixture 22 was approximately 17% to 35% powdered aluminum with the remainder 40% TNT and 60% RDX. An electrical charge through cable 19 ignited detonators 24 and 26 located at the upper and lower end of the container, respectively.

This particular arrangement was used several times to sever multiple casing string. In each case, the inner casing would split longitudinally at spaced intervals around the periphery of the pipe and split laterally a short distance at the end of the longitudinal splits forming the S-shaped splits shown in FIG. 3. The longitudinal splits were not unexpected since it takes 50% less force to split the pipe longitudinally then to sever the pipe laterally, i.e., along a line transverse the longitudinal axis. The upper and lower ends of the S-shaped splits show the beginning of transverse failures. So the problem was to get the upper and lower lateral splits of the S-shaped splits to connect, which would result in the removal of 4–5 foot sections of the concentric casing.

This was successfully accomplished using the arrangement shown in FIG. 4 and generally indicated by the number 40. It includes cylindrical container 42 closed at the bottom by end plate 44 and at the top by end plate 46. Electric cable 49 is connected to eye bolt 48 in the top plate for supporting the container as it is lowered into the casing. The electric cable also carries the electric charge required to fire detonator 47 and set off the explosive in the container.

Located in the center of container 40 is sealed cylinder 43 positioned in the center of the container with its longitudinal axis extending along the longitudinal axis of container 40. Cylinder 43 contains only the air trapped in the cylinder when it is sealed. Cylinder 43 may be comprised of a light-wall tubing, such as sheet metal pipe, or other collapsible material. Cylinder 43 is surrounded by high velocity aluminized explosive mixture 45. As in the previous arrangement, the preferred aluminized explosive mixture is approximately 17% to 35% powdered aluminum, with the remainder of 40% TNT and 60% RDX. An electrical charge through cable 49 ignites detonator 47 located at the upper end of the container to set off the aluminized explosive mixture.

It is believed that detonation of the mixture produces a shock wave and gas bubbles that travel away from the detonation point toward the sealed cylinder at the center of the container. The shock wave and gas bubbles produced by the TNT, RDX, and aluminum mixture progressively collapse the sealed cylinder as the shock wave passes along its length. The pressure of the air within the cylinder will increase as the cylinder collapses causing the cylinder to rupture sending highly compressed air laterally toward the concentric casing thereby directing the full force of the rapidly expanding gases against the inside wall of each casing string in succession until a section of each casing string has been removed. The compressed air is forced to move laterally by the head of water in the casing above the container.

In the first test of the assembly shown in FIG. 4, approximately 4 to 5 foot long section of each casing in the string was missing. The severed casings do not have frayed edges at the severed ends. It is believed that the shock waves caused by detonation of the explosives contained in the preferred embodiment of the present invention first initially produce the longitudinal splits shown in FIG. 3 followed by the lateral splits at each end. Contrary to the previous arrangement, however, the lateral splits meet at which time the walls of the casing is split into a plurality of separate pieces that are blown against the next outer casing until a vertical section of each casing string has been reduced to a plurality of slightly curved pieces of metal.

FIG. 5 shows a preferred embodiment of the invention 50 positioned within the inner most casing string 40 of multiple concentric well casing strings. The outer diameter of the cylindrical container in a preferred embodiment will be approximately 1 and ½ inch less than the inner diameter of the inner most casing. The length of the container will be dependent upon the amount of explosives required to sever the multiple strings of casing. The quantity of TNT, RDX, and aluminum mixture required for severing multiple casing strings will be influenced by the number of casing strings, the diameters of the individual casing strings and, the materials, such as water, sediment or cement, within the casings surrounding the inner most casing. The collapsing of the sealed cylinder and the forcing of the pressurized air in the cylinder in a lateral direction and thereby forcing the shock wave and gas bubbles in a lateral direction, enhances the casing severing capability of the explosive. Therefore, lesser amounts of explosive can be used to accomplish complete severance of multiple concentric casing strings. Using smaller amounts of explosive minimizes disruption to surrounding marine habitats.

From the foregoing it will be seen that this invention is one well adapted to attain all of the ends and objects hereinabove set forth, together with other advantages which are obvious and which are inherent to the apparatus and structure.

Because many possible embodiments may be made of the invention without departing from the scope thereof, it is to be understood that all matter herein set forth or shown in the accompanying drawings is to be interpreted as illustrative and not in a limiting sense.

What is claimed is:

1. Apparatus for severing multiple concentric casing strings in an abandoned, oil or gas well located in a body of water to allow the upper portion of the casing strings to be removed so as not to be a hazard to navigation, comprising a container for positioning in the casing at the location of the desired cut, said container having a quantity of high velocity explosive surrounding a sealed cylinder in the center of the container, a detonator located at an end of the container for detonating the high velocity explosive to cause a shock wave and gas bubbles to move toward the sealed cylinder and collapsing the cylinder causing it to fail, whereby the pressurized air from the cylinder causes the shock wave to move laterally through the casing strings.

2. The apparatus of claim 2, in which the sealed cylinder is positioned vertically in the center of the container.

3. Apparatus for severing multiple concentric casing strings in an abandoned, oil or gas well located in a body of water to allow the upper portion of the casing strings to be removed so as not to be a hazard to navigation, comprising a container for positioning in the casing at the location of the desired cut, said container having a quantity of explosive comprising a mixture of TNT, RDX, and aluminum and a sealed cylinder in the center of the container surrounded by the explosive, and a detonator located at an end of the container for detonating the explosive to cause a shock wave and gas bubbles to move toward the center and collapse the sealed cylinder causing the cylinder to fail, whereby pressurized air from the cylinder causes the shock wave to move laterally through the casing string.

4. A method of simultaneously severing multiple concentric casing strings in an abandoned, oil or gas well located in a body of water to allow the upper portion of the casing strings to be removed so as not to be a hazard to navigation comprising lowering an elongated container holding a sealed cylinder in the center of the container and a high velocity explosive surrounding the sealed cylinder, detonating the high velocity explosive at one end of the container so that the high velocity explosive produces a shock wave and gas bubbles that travel toward the sealed cylinder, the high velocity explosive reaching the sealed cylinder and collapsing the cylinder causing it to fail, whereby pressurized air from the cylinder causes the shock wave and gas bubbles from the high velocity explosive to move laterally to sever the upper portions of the concentric casing strings from the lower portions thereof.

5. A method of simultaneously severing multiple concentric casing strings in an abandoned, oil or gas well located in a body of water to allow the upper portion of the casing strings to be removed so as not to be a hazard to navigation comprising lowering .an elongated container holding a sealed cylinder in the center of the container and a mixture of TNT, RDX, and aluminum surrounding the sealed cylinder, detonating the TNT, RDX, and aluminum mixture at one end of the container so that the TNT, RDX, and aluminum mixture detonates toward the sealed cylinder thereby producing a shock wave and gas bubbles that travel toward the sealed cylinder and collapse the sealed cylinder causing it to fail, whereby pressurized air from the cylinder causes the shock wave and gas bubbles from the TNT, RDX, and aluminum mixture to move laterally to sever the upper portions of the concentric casing strings from the lower portions thereof.

* * * * *